US008232686B2

(12) United States Patent
Ditillo

(10) Patent No.: US 8,232,686 B2
(45) Date of Patent: Jul. 31, 2012

(54) SAFETY DEVICE FOR EMERGENCY INTERRUPTION OF DRILLING MANEUVERS

(75) Inventor: Alessandro Ditillo, Cesena (IT)

(73) Assignee: Soilmec S.p.A., Cesena (FC) (IT)

( * ) Notice: Subject to any disclaimer, the term of this patent is extended or adjusted under 35 U.S.C. 154(b) by 254 days.

(21) Appl. No.: 12/720,380

(22) Filed: Mar. 9, 2010

(65) Prior Publication Data

US 2010/0237714 A1 Sep. 23, 2010

(30) Foreign Application Priority Data

Mar. 20, 2009 (IT) ..... TO2009A0217

(51) Int. Cl.
*H02H 11/00* (2006.01)

(52) U.S. Cl. ..... 307/326

(58) Field of Classification Search ..... 307/326; 192/133; 175/92, 133
See application file for complete search history.

(56) References Cited

U.S. PATENT DOCUMENTS 6,325,195 B1 * 12/2001 Doherty ..... 192/133
7,293,607 B2 * 11/2007 Lambert et al. ..... 166/75.11

* cited by examiner

*Primary Examiner* — Jared Fureman
*Assistant Examiner* — Carlos Amaya
(74) *Attorney, Agent, or Firm* — Merchant & Gould P.C.

(57) ABSTRACT

A safety device for the emergency interruption of the drilling maneuvering in a drilling machine is provided with a guide tower or mast (17) and a device (10) for realizing the driving in the ground of drilling elements. The device includes at least a frame (12) fixed to the mast and provided with at least an arm or a door (11) rotating around an axis (Y) with respect to the frame. A microswitch (23) is activated by the movements of rotation given to the door (11) for stopping at least some of the dangerous drilling maneuvering.

12 Claims, 7 Drawing Sheets

SAFETY DEVICE FOR EMERGENCY INTERRUPTION OF DRILLING MANEUVERS

This application claims benefit of Serial No. TO2009A000217, filed 20 Mar. 2009 in Italy and which application is incorporated herein by reference. To the extent appropriate, a claim of priority is made to the above disclosed application.

BACKGROUND

The field of the present invention is related to the drilling machines which functioning in many technological fields, can require from the auxiliary services personnel manual interventions in zones exposed to dangers.

SUMMARY

In particular, all the drilling machines require interventions from the personnel generally subdividable into: first mounting interventions, maintenance interventions and manual interventions contemporary to the working maneuvers.

In the first case, as regards to the front zone in which there is the mast which brings the driving head free to slide along the guides of the mast itself, potential dangers are clear such as coming into contact with moving parts, with rotating objects or with the risks of a machine not already tested, therefore for instance, with unpredictable operations.

However, during the step of the first mounting, the installation care personnel is generally prepared for dealing with this kind of issues and the attention threshold of the personnel is high because the work is each time different and never repetitive. The base installations of transformation for making the machine suitable for a specific technology are specific and different case by case.

Therefore, the experience, the skills and the specificity of the work bring to consider this step as not particularly dangerous.

In the second case, the maintenance interventions can be required after scheduled operations of specific actions caused by unpredicted issues. Even in this case the experience of the intervention personnel, the specificity of the issues and the usual practice bring to consider this step as not particularly dangerous.

In the third case, in which are required manual interventions during the working steps, for example for supplying the drilling rods as regards to the zone in proximity of the mast, the risk exposure is very high because the operations are of routine type (and this physiologically creates an attention reduction in people who does repetitively the same action), with parts in speedy movement and timetable to reduce to the maximum for increasing the productivity.

All these elements cooperate as an explosive mixture, for exposing the maneuvering personnel to potential dangers which can be hardly reduced with protecting means or suitable maneuvering procedures.

For all these reasons, in proximity of the mast, it is to be located a device for the emergency interruption, which rapidly and safely interrupts the main drilling maneuvers: the rule requires the instantaneous interruption of the rotation and of the moving forward and backward of the driving head, given to the rods by the driving head.

The same rule UNI EN 791 generically prescribes the following:

Emergency Interruption.

In order to prevent an effective or potential danger, devices for the emergency interruption must be supplied. They must interrupt the most rapidly possible any dangerous movement, for avoiding the development of a dangerous situation without, however, creating additional dangers. In each operating or piloting station there must be an emergency device. A device for the emergency interruption with local effect must interrupt a specific and limited function, such as rotation and moving forward.

The devices for the emergency interruption must be placed in positions easily reachable by the operator. The emergency interruption, after the operation, must remain active until it is manually rearmed. This manual rearm must not start the machine, but shall only enable the reboot via the normal procedure. More in particular for the safety devices in proximity of the mast, the rule prescribes:

Safety Device for the Interruption of Rotation and of the Moving Forward.

The drilling machines with a forward movement guide, if there is the danger for the personnel for being caught up and injured by the rotating element, must be provided with additional sensitive devices, in the immediate surroundings of the system of rods of the rotating driller, accessible by the personnel. The sensitive devices must be installed and equipped in such a way as to be automatically started in emergency situation by the body, or parts of the body, without any delay or difficulty. The actuators of the sensitive device must be clearly marked. If the drilling machine is equipped with a system for tube or drilling rod handling, it is sufficient a sensitive device on the free side of the tube or of the drilling rod. When the sensitive device is started, any energy residual in the system must be contained or dissipated in such a way as to not cause dangerous movements.

The sensitive device, after the operation, must remain active until the manual rearm. This manual rearm must not start the machine but shall only enable the reboot via normal procedure. If such a sensitive device cannot be realized because of operating modes, the dangerous zone must be a forbidden entry zone during the drilling and during the carrying out of other dangerous operations. The forbidden entry area must be indicated by the sign "Off limits".

As it is shown in the normative steps in force, there is wide freedom to choose the sensitive device, even if the practice of use or state of the art is concentrated on some very precise solutions. The first device which regularly finds application in almost all of the drilling machines in which is required the manual intervention for the mounting of rods, is the so-called "emergency rope" or "emergency cable". This device is characterized by a lower arm which has a coupling upon which is bolted a tensioning element of the cable, which has at its opposed end, a coupler for the rope (generally in plastic material and red colored for being clearly marked and evident).

On the opposite end of the rope, it is connected a positive controlled double-contact microswitch, which is pre-tensioned with a pre-charging stroke manually given to the tensioner. In case of emergency or danger, the operator in proximity of the mast can pull in any direction the rope. This movement causes the extension of the piston of the microswitch, which after a very short stroke (from 3 to 5 mm) releases the contact and the dangerous maneuvers are immediately interrupted.

The rearm, as prescribed by the rule, is then carried out in proximity of the sensitive device itself, by counter-rotating a button (generally red) provided for this rearm maneuver. Obviously, the microswitch must therefore find itself to eye level, for being safely and easily rearmed.

In case of breaking of the emergency cable, the piston of the microswitch returns in completely closed position, losing the pre-tensioning and this causes anyhow the interruption of the dangerous maneuvers and warns the operator that a part of the security system is damaged.

The negative aspects of this solution are such that it is considered as non-safe. The main aspects are all connected to the ease with which the microswitch carries out its stroke and releases the interruption of the maneuvers. In particular the presence of vibrations (completely normal in movement or during the drilling) or of scarce tensioning of the system (the same rope caves in and relaxes during the time or it is subject to extensions owing to the exposure to thermal gaps) always produce a continuous inserting of the microswitch which, by repetitively interrupting the maneuvers, makes it impossible to maneuver the machine and work with continuity.

Furthermore if the emergency cable is mounted in long version as covering of all the antenna, these issues are more evident. In this case little movements are enough for inserting the microswitch. In this case then the microswitch to be rearmed is to be placed on the arm or lower support doors for being accessible and this causes problems of false contacts and malfunctions due to the narrow contact with the aggressive environment typical of the building sites. For all these reasons, it is an established practice to find in working environments these devices not functioning or jumped, to the detriment of the safety of the maneuvering personnel who does not have anymore functioning devices for the interruption of the maneuvers in case of imminent danger.

Another constructive embodiment, in alternative to the preceding one, provides for the use of emergency buttons positioned on arms or support doors on the sides of the mast.

This solution is used when the drilling machine has a very small size and its use is provided for inner works, in the renovation of buildings or in the carrying out and consolidation of tunnels having a reduced transversal section.

In these cases, the presence of the emergency rope is an obstacle to the maneuvers and limiting for the executable drillings.

Therefore, only as fallback choice, are installed these devices which have a very negative aspect, that is to say that they are not such as to be intercepted with the movement of the body of the operator (as a matter of fact, the rule prescribes that: the sensitive devices must be installed in such a way as to be automatically started in emergency situation by the body, or parts of the body, without any delay or difficulty. As a matter of fact, the standard emergency buttons have a reduced diameter and, in case of emergency, are to be searched for in a very precise point of the space around the mast.

For obviating to this big limit, one should scatter the lateral zones of the mast with a very high number of these devices, with consequent problems for the installation. It is to be considered also the difficulty of understanding which device is the one activated and therefore to be rearmed. A final known embodiment relates to a sensitive device constituted by an operating plate that is hinged on a side.

The pressure exerted on the plate, which acts in contrast with elastic devices, causes the insertion of a microswitch contained inside a containing covering. The structure appears therefore as a flat box, within which there are the microswitch and the elastic elements and on the front part a movable cap for the pressure and the activation of the signal.

These devices do not perfectly comply with what the rule prescribes because the rearm does not take place in loco on the microswitch (which remains closed inside the red box) but from a command position away from the point in which it has been activated. This detail is not minor, because from the point of view of the safety from a position different from the activation one, it is not ensured that the danger for which the insertion of the sensitive device has been requested, is terminated, and a second person could activate the installation restarting the machine and consequently putting back in danger the operator still exposed.

Furthermore, the activation plates, even big, are limited to a restricted zone and prevent with their shape from safely carrying out the charging of the rods.

Lastly, the box with the movable cap is not sealable and being in proximity of the hole, is subject to castings of drain materials, concrete mixings which fill the inner parts by causing general malfunctions and requesting frequent reset activities.

Finally, there are known devices of closing and prohibition of the zone at risk on the hole border, represented by true railings which circumscribe the area prohibited to the personnel. These barriers, known with the term guarà due to the fact that their application is specific of the English market, are closed in all the steps of the drilling and when opened, activate a microswitch positioned on the part of the movable railing, which interrupts the most risky maneuvers such as the speedy movements of rotation of the rods and the speedy ones of moving forward and backward the driving head. Furthermore, for clarifying to the personnel in the building site that the machine is exposed to dangers and that the operator can enter a risky zone, are activated by the same microswitch also one or more blinking lamps and buzzers.

Obviously, this metallic protection creates some logistic issues for the operators who must handle the rods for continuing the drilling and do not ensure an efficient safety against damages towards residual movements, even if they are slow.

Therefore, in combination with these systems, it is required the mounting of sensitive devices, generally emergency ropes, positioned inside the guard, for interrupting the drilling maneuvers. Purpose of the invention is to overcome the preceding limits and to solve all the highlighted issues by realizing a strong sensitive and always functioning device, compatible with the stresses caused by the heaviest works and adjustable in position.

For these and other purposes which will be later more understood, the invention proposes to realize a safety device for emergency interruption of the drilling maneuvers.

BRIEF DESCRIPTION OF THE DRAWINGS

The invention will be now described referring to the appended drawings wherein.

DETAILED DESCRIPTION

Figure 1:
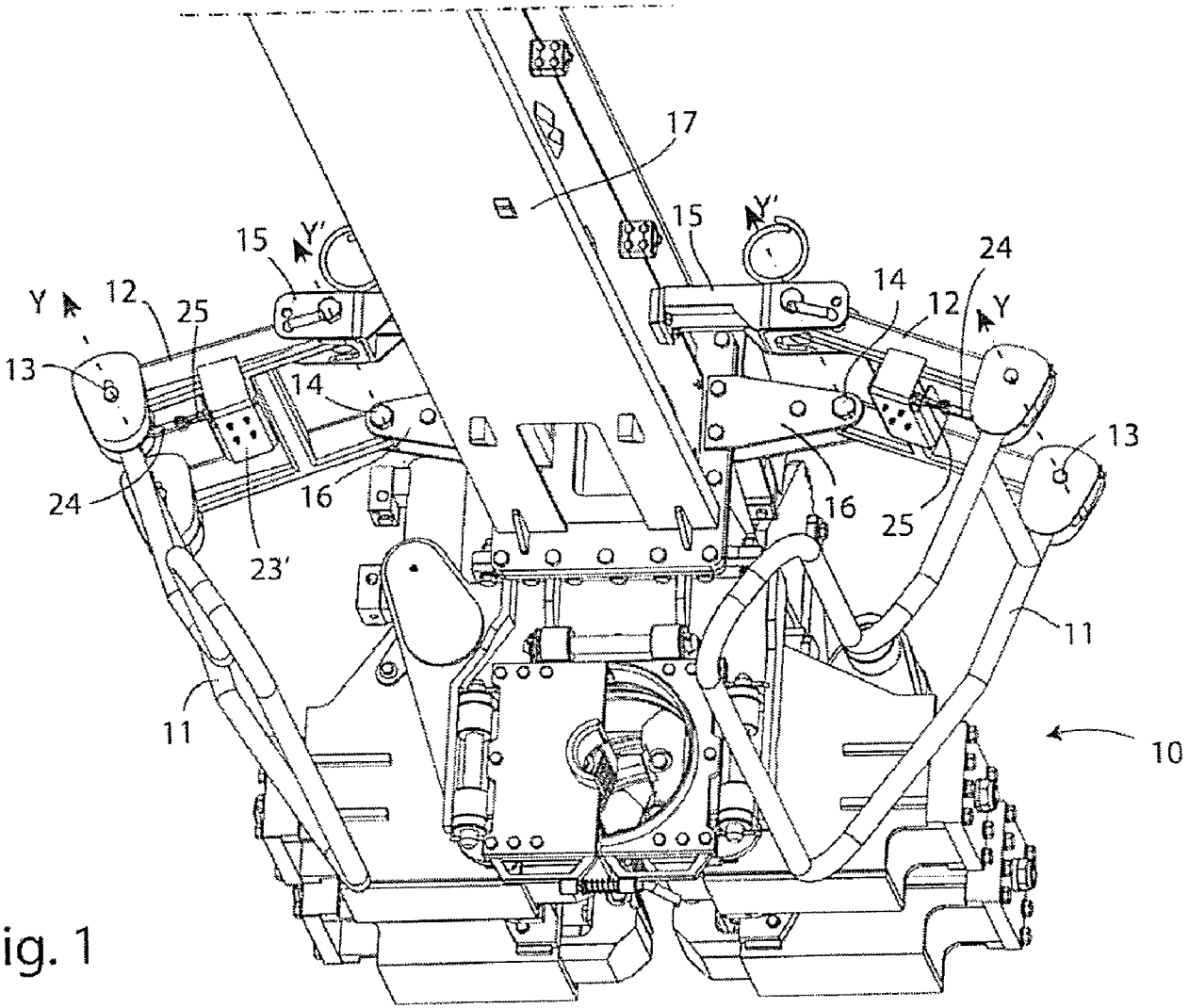
FIG. 1 shows the base of a drilling machine provided with the device according to the invention in a first form of embodiment in closed position.
Figure 2:
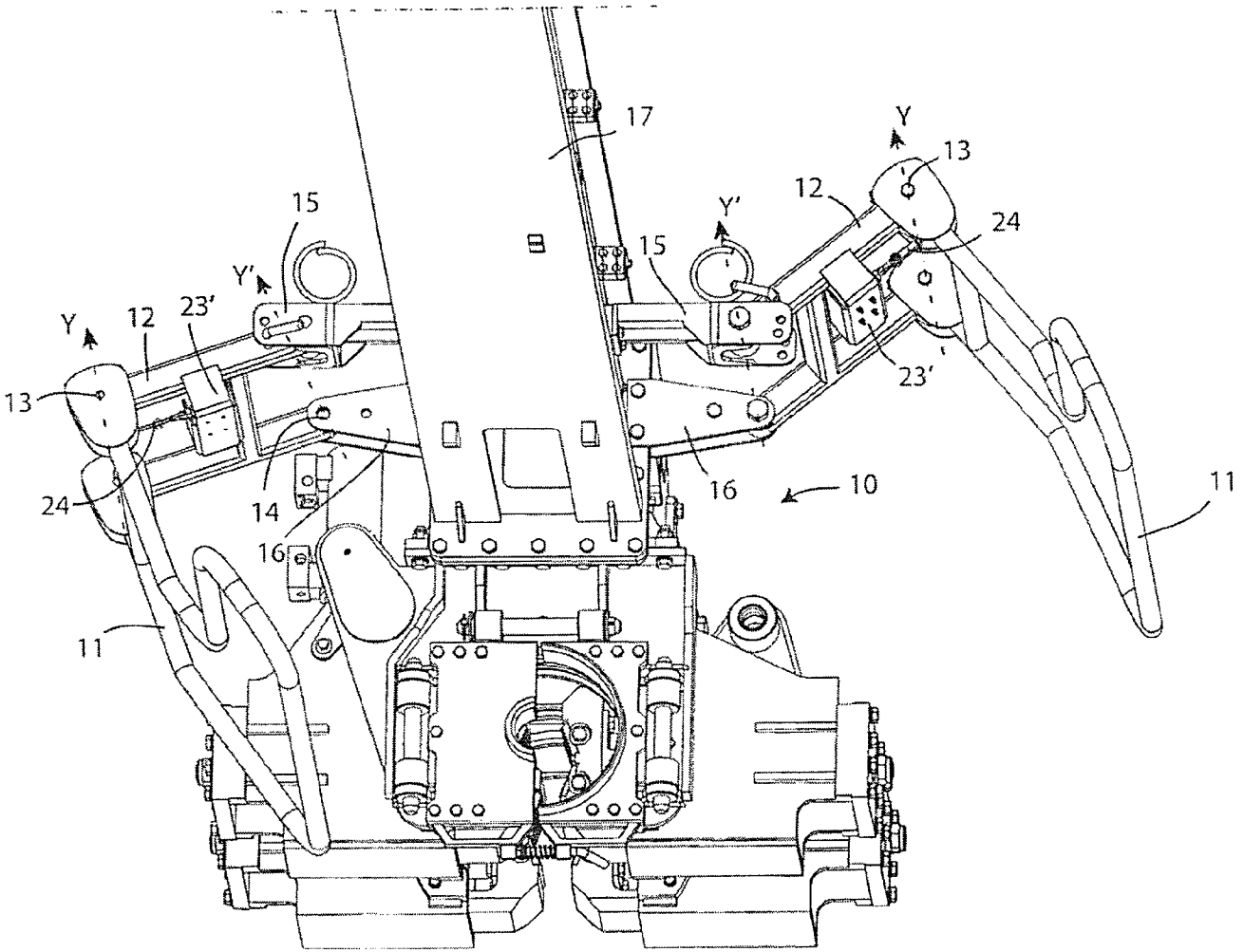
FIG. 2 shows the device of FIG. 1 in partially opened position.
Figure 3:
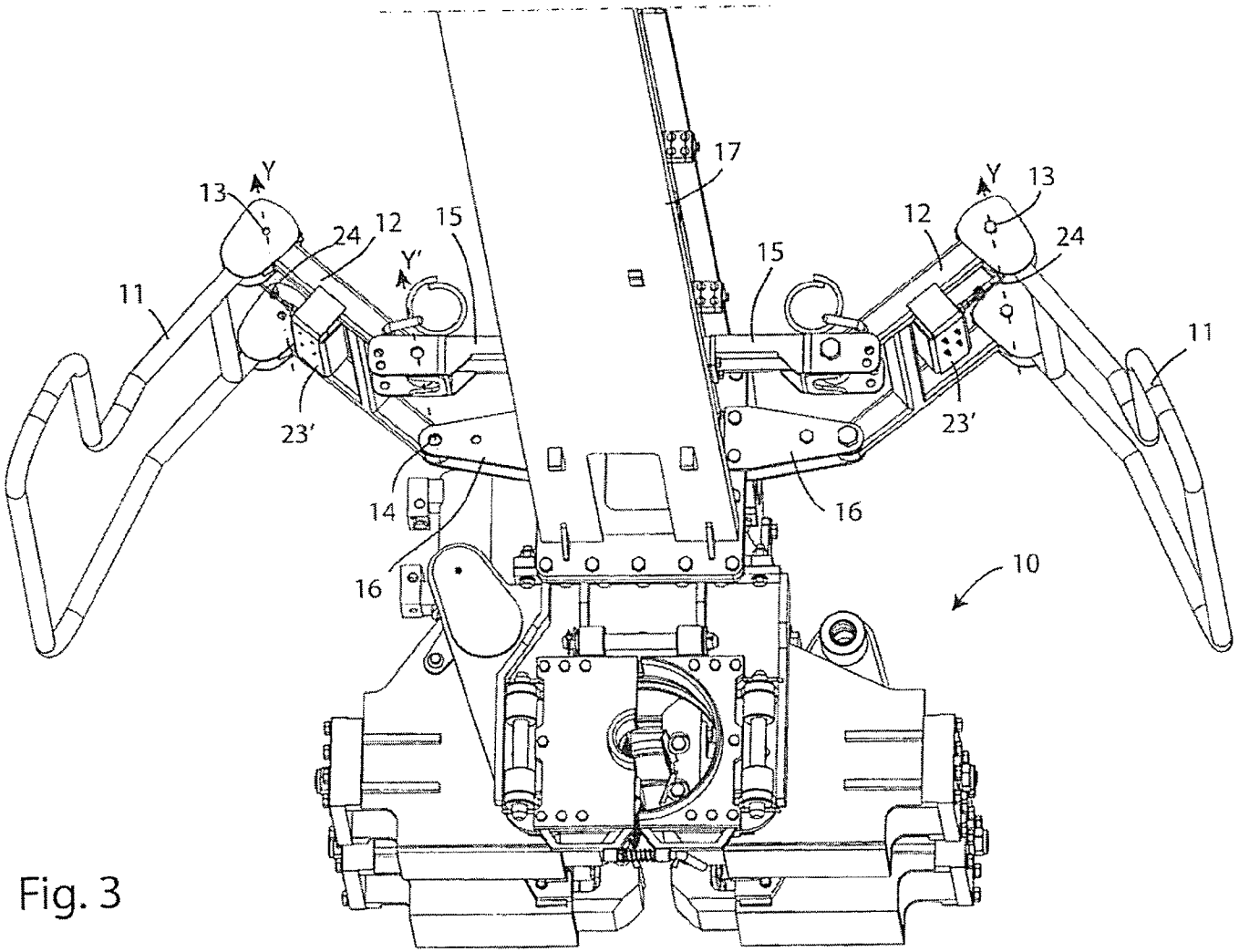
FIG. 3 shows the device of FIG. 1 in completely open position.
Figure 4:
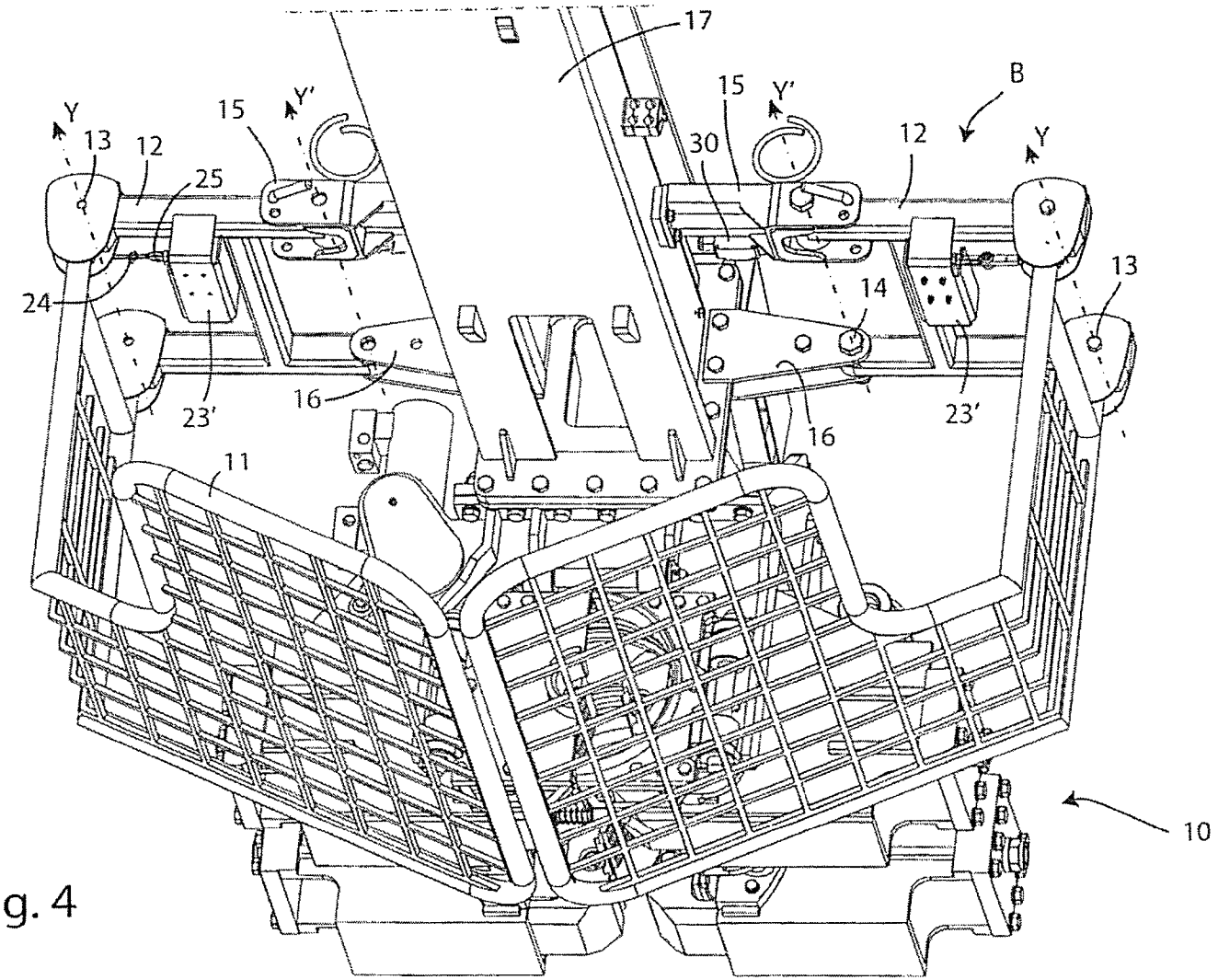
FIG. 4 shows the base of a drilling machine provided with the device according to the invention in a second form of embodiment in closed position.
Figure 5:
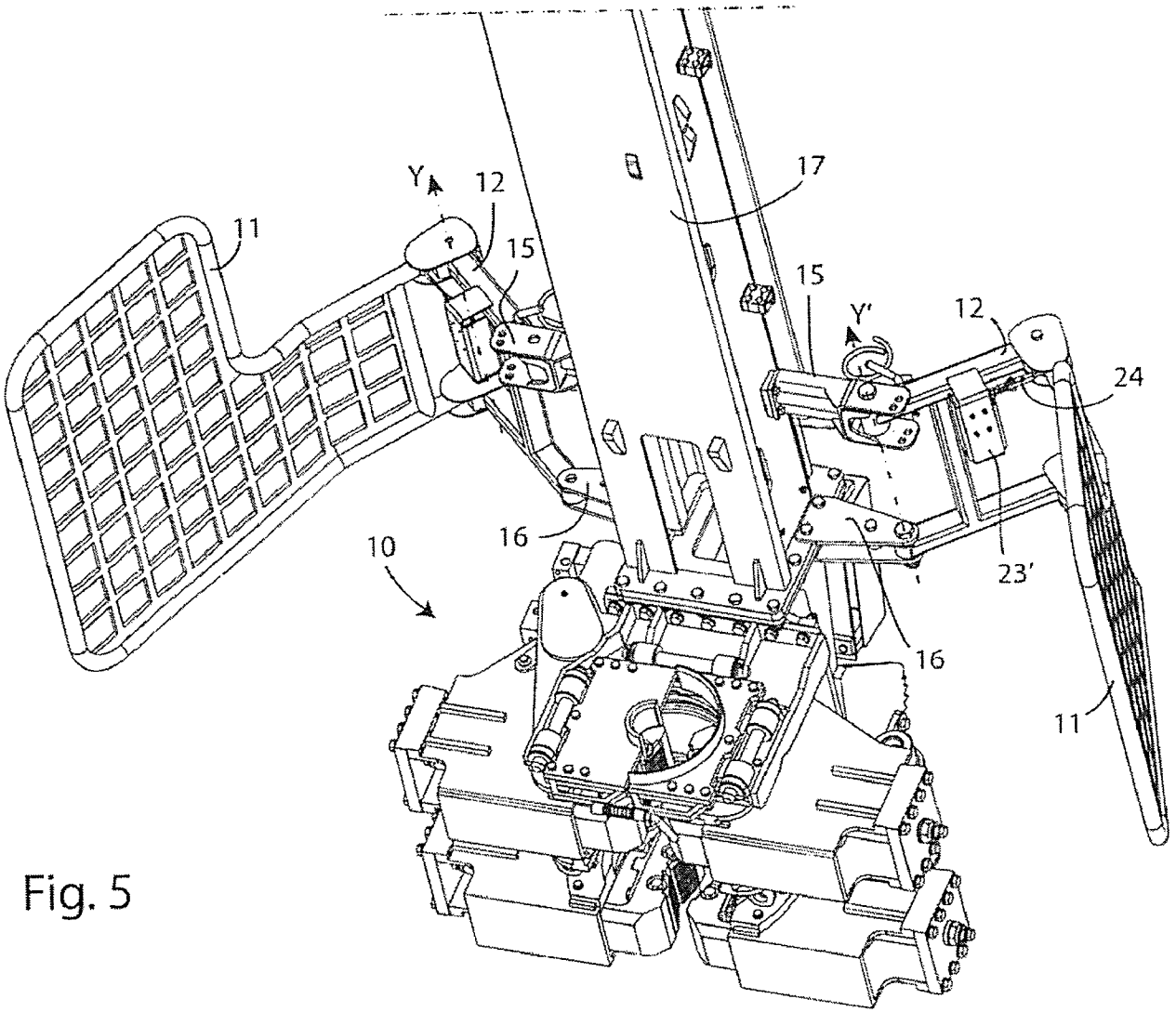
FIG. 5 shows the device of FIG. 4 in completely opened position.
Figures 6, 7:
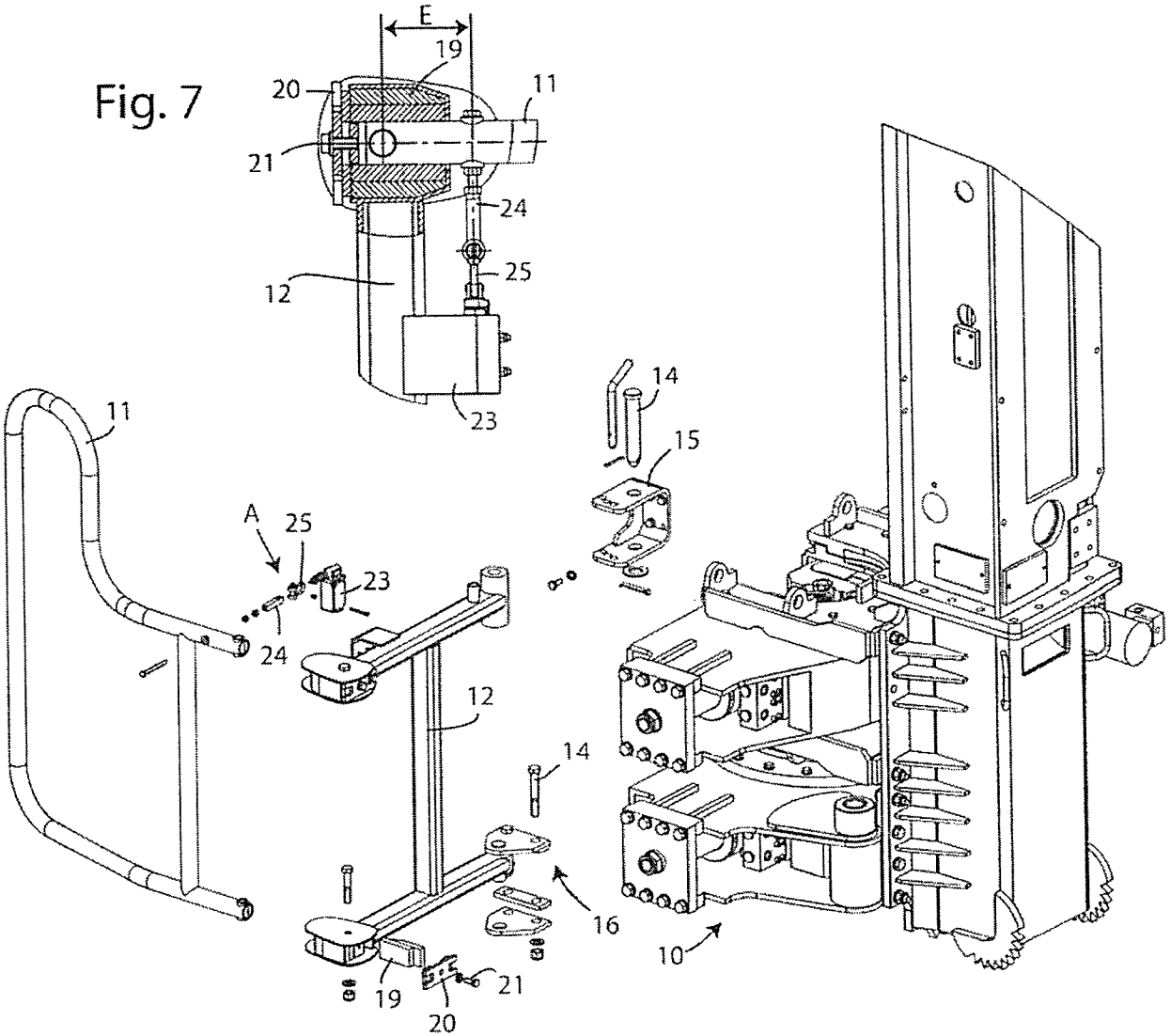
FIG. 6 is the exploded view of the device of FIG. 1-3.
FIG. 7 is the section of the particular A mounted of FIG. 6.

In FIGS. 1-6 is shown the base of a drilling machine 10 (it is represented only the lower part of the drilling tower) to which are applied the safety devices object of the invention.

In these figures, there are two arms or tubular doors 11 of any shape, represented with an upper part extended upwards as a shackle; they are hinged to respective frames 12 around a vertical axis Y of rotation detected by pins 13; in turn the frames 12 are hinged to brackets 15 and 16 fixed to the mast 17, around vertical axis Y detected by pins 14.

The arms or doors 11 can rotate around the axis Y pushed or pulled by a manual force exerted on one of the points along the development of the tubulars themselves of the shackle. Damping elements 19 (see FIG. 6) are tight against the end of each arm or door 11 by means of a plate 20 adjustable by means of screw means 21 for obtaining an opportune and ideal damping of the vibrations on the arm.

Each frame 12 laterally brings a covering 23' containing a controlled double contact microswitch 23 (of commonly known type and therefore not described in further details), connected by means of a mechanic rod adjustable in length 24 and on the buttonhole 25 which connects the end of the activation piston of the microswitch to the rotating bar 11.

The rod 24 serves for conveniently pre-tensioning the piston of the microswitch 23 by arranging it in median position of its stroke, corresponding to the neutral condition.

A predefined extra-stroke in extension or in shortening with respect to the neutral condition of start (pre-tensioned) brings the piston to vary the contact and consequently to activate the action of the microswitch 23.

The rotation of each arm or door 11 around the axis Y causes an extension or shortening of the piston of the microswitch 23, proportional to the width of the angular movement of rotation of the arm or of the door itself.

By adjusting the positioning eccentricity E of the axis of the piston of the microswitch 23 (see FIG. 7) with respect to the rotation point of the arm or door 11, it is possible to plan an ideal movement on the microswitch starting from a rotation lane considered as more appropriate.

The frames 12 are supported by the mast by couplings of various shape (16, 15) suitable for keeping fixed the frame in a number of multiple positions, more or less near to the drilling axis, for ensuring a suitable protection of the most dangerous zone.

The rotation of both or even only one of the two arms or doors 11 around the axis Y causes an extension or shortening of the respective piston which activates the corresponding controlled double contact microswitch 23.

The microswitch 23 will be connected to command activator means of parts of the machine, such as for example the ones which carry out the rotation and the moving forward of the drilling rods, determining their immediate disengagement with the consequent interruption of the rotation and of the moving forward or backward of the rod, that is to say of the main functional parts of the machine.

However, it is possible to command the disengagement of other functions potentially dangerous, all referable to the drilling maneuvers (movements of vices, charger, auxiliary pumps, percussions, and so on).

Figure 8:
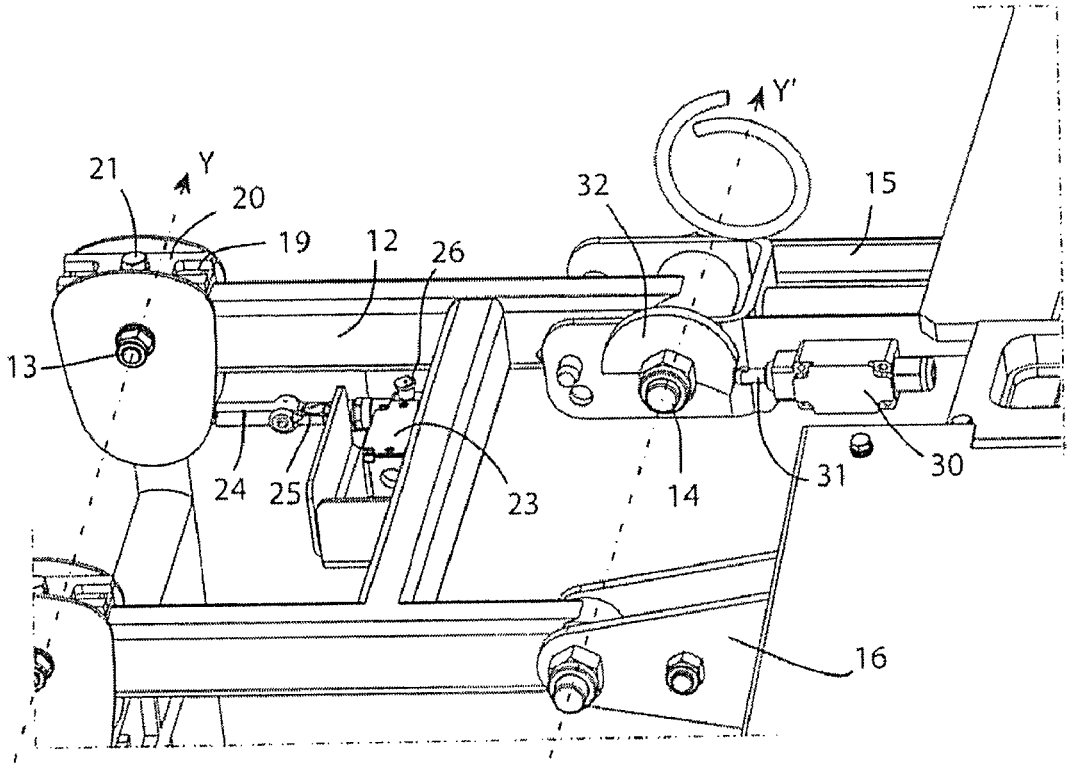
FIGS. 8 and 9 are views of the particular B of FIG. 4 in two different operating steps.
Figure 9:
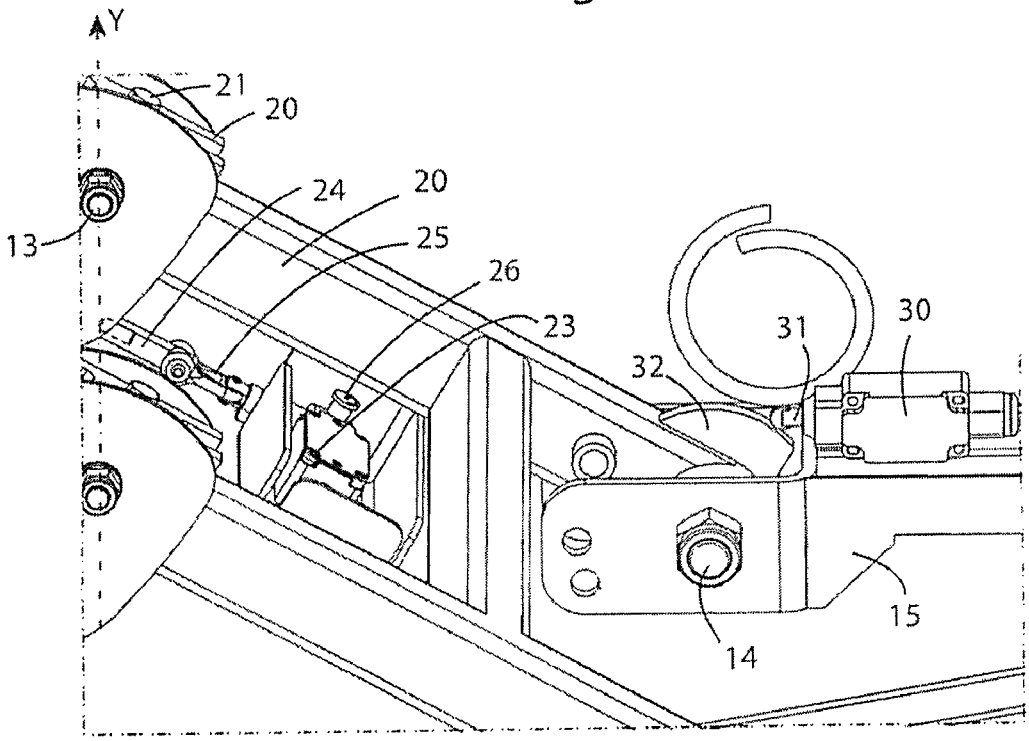

The return to the center of the arm or of the arms 11 is automatic because it is ensured by rubber pads 19 which crushed by the movement of the arm, elastically push the same to return in balanced position. For the purpose, the rubber pads 19 are two and opposed with respect to the tubular arm 11. For rearming the system, it will be necessary to counter-rotate the button 26 present on each microswitch 23 (see FIGS. 8 and 9). The rearm permits to the operator to activate the normal starting procedures and to restart with the working operations, commanding all the necessary maneuvers.

If the arms or doors 11 are of guard type, (form of embodiment shown in FIGS. 4 and 5), therefore provided with metallic protection net as impediment for entering the dangerous zone, in proximity of the rotation axis Y' of the supporting frame 12 on one of the brackets 15 integral with the mast 17, is inserted a second microswitch 30 (see FIGS. 8 and 9) activated by the pressure of a piston 31 which, due to the rotation of the corresponding frame 12 of the guard, around the axis Y', is pushed by a cam 32 integral with the frame itself 12.

The intervention of the microswitch 30 will cause the intervention of, for example, the so-called decalibration mode, that is the reduction of the maneuvering speed and the turn-on of signalization blinking lamps and/or warning buzzers.

The advantage of that system with respect to the existing guards, is represented by the fact that the arms or tubular doors 11 which act as metallic protection, keep the properties of sensitive device, thus they do not request the insertion of additional systems, simplifying machine and installations and keeping unchanged the principle of safety functioning which remains the innovative one, with arms or mechanical doors.

The device above described permits to obtain the following advantages:

- Elimination of all the issues caused by the presence of the rope (extensions, low resistance of the cable, and so on).
- Possibility of adjusting the tubular shape of the arm or door for obtaining shapes more or less efficient and adaptable to the different technologies and to the different tools.
- Possibility of acting on extended contact zones and as a covering of the entire space around the hole.
- Possibility of adjusting the radial overall dimensions of the arm or tubular door with respect to the hole.
- Motion of the microswitch in a rear position away from the hole and therefore in a more protected and clean environment.
- Possibility of varying the geometry for obtaining minimal strokes of the piston also against relevant angular rotations of the arm or tubular door, approaching its position to the drilling axis.
- Horizontal arrangement of the axis of insertion of the microswitch in orthogonal position with respect to the main directions of vibration connected to the use of the machine (generally of vertical type, mainly in presence of vibrators and hammers).
- Possibility of damping the vibrations and modulating the activation force by adjusting the rubber pads pressed against the arm or the tubular door.
- Possibility of extending the arm or the tubular door on all the length of the mast for protecting all the parts subject to potential moving and rotating means, thanks to the rigidity and hardiness of the metallic tubulars.
- Possibility of realizing the guards, by closing the loop of the arm or tubular door with a metallic net and by mounting a twin arm or door on the part opposite to the first, with the relative microswitches which signal the carried out opening of the corresponding door of the guard.

The invention claimed is:

1. A safety device for the emergency interruption of drilling maneuvering in a drilling machine provided with a device for driving in the ground of drilling elements; comprising at least a frame fixed to a mast and provided with at least an arm or a door rotating around an axis with respect to said frame; a microswitch being activated by movements of rotation of the arm or door for stopping drilling maneuvering.

2. A device according to claim 1, wherein the arm or door is tubular and has a closed perimeter shape.

3. A device according to claim 1, wherein the frame comprises two frames mounted on opposed sides of the mast and the arms or doors comprise two arms or doors, each arm or door provided with said microswitch for detecting the rotation of each one of the arms.

4. A device according to claim 1, wherein the microswitch is a positive controlled double contact microswitch, connected to the rotating arm by a mechanic rod adjustable in length that connects an end of an activation piston of the microswitch to the rotating arm.

5. A device according to claim 4, wherein the rod and the axis of the related piston are positioned eccentrically with respect to the axis of rotation of the corresponding arm or door.

6. A device according to claim 1, further comprising damping elements on the frame, in correspondence to the connection of the arm, wherein the damping elements are adjustable by screw means, for limiting vibrations and acting in elastic contrast against the arm for moving the arm to a centered neutral position.

7. A device according to claim 1, wherein the frame is temporarily releasably hinged to the mast and rotating around a second axis with respect to the mast.

8. A device according to claim 7, wherein the frame is adjustable in position with respect to the mast for adequating the distance of the arm from the drilling axis.

9. A device according to claim 1, wherein at least an arm extends all along the length of the mast.

10. A device according to claim 1, wherein the arm or the door is covered within a metallic net and on the frame is inserted a second microswitch, after the rotation of the corresponding frame, the second microswitch signals opening of the arm.

11. A device according to claim 10, wherein the rotation maneuvering determined by the opening of the guard activates the microswitch to release a decalibration mode that is the reduction of the maneuvering speed, and the eventual activation of blinking lamps and/or sounding buzzers installed on the drilling machine.

12. A device according to claim 10, wherein the microswitch is activated by pressing a piston pressed by a cam integral with the frame.

* * * * *